United States Patent [19]

Peterson, Jr.

[11] 3,961,382

[45] June 8, 1976

[54] HYDROTHERAPY BATH ASSEMBLY

[75] Inventor: Samuel F. Peterson, Jr., Chicago, Ill.

[73] Assignee: Associated Mills, Inc., Chicago, Ill.

[22] Filed: Sept. 16, 1974

[21] Appl. No.: 506,317

Related U.S. Application Data

[63] Continuation-in-part of Ser. No. 420,225, Nov. 29, 1973, abandoned.

[52] U.S. Cl. ..... 4/178; 4/180; 128/66; 415/126; 417/424

[51] Int. Cl.[2] ..... A61H 9/00

[58] Field of Search ..... 4/1, 178, 180, 182; 415/126, 127, 201; 417/424; 128/66

[56] References Cited

UNITED STATES PATENTS

| | | | |
|---|---|---|---|
| 2,555,686 | 6/1951 | Farrelly et al. | 4/180 X |
| 2,587,335 | 2/1952 | Landergott | 4/180 |
| 2,782,425 | 2/1957 | Schroeter | 4/178 |
| 2,890,659 | 6/1959 | Haentjens et al. | 415/126 |
| 3,336,921 | 8/1967 | Lloyd | 4/180 X |
| 3,396,722 | 8/1968 | Lindberg, Jr. | 4/180 X |
| 3,530,852 | 9/1970 | Fattor | 128/66 |
| 3,814,086 | 6/1974 | Lemb | 128/66 |
| 3,846,848 | 8/1973 | McNair | 4/178 X |

*Primary Examiner*—Richard E. Aegerter
*Assistant Examiner*—Stuart S. Levy
*Attorney, Agent, or Firm*—Allegretti, Newitt, Witcoff & McAndrews

[57] ABSTRACT

A portable whirlpool or hydrotherapy bath assembly of the type which mounts on the upper edge of the wall of a bath tub. The assembly includes a motor housing, a spaced generally upright pump housing, and an overhead support which is secured to the upper ends of both housings. The pump drive shaft is mounted in an upright position in the pump housing. Means are provided for rotatably mounting the pump housing to the overhead support for rotation about the axis of the drive shaft. A pump impeller is mounted on the lower end of the drive shaft in a pump chamber which is unitary with the pump housing. A water inlet is positioned at the lower central portion thereof. A water volume control is provided for adjusting the volume of water passing through the water inlet. The pump impeller raises the pressure of the water and the pressurized water is passed through the water outlet which is unitary with the pump housing and is rotatable with the pump housing for changing the direction of pressurized water flowing from the outlet. Means are provided for mixing air with the pressurized water for aeration thereof. Control means are provided for varying the volume of air mixed with the water. A flexible hose may be connected to the water outlet, and alternatively, more than one such hose may be connected to the water outlet. A nozzle is connected to the outer end of each hose and is used to direct pressurized water to a localized part of the user's body.

10 Claims, 15 Drawing Figures

16
28
50
82
80
30
48
84
32
26
92
6
6
7
7
86
64
124
4
4
5
5
126
124
127
128
122
122
118
78
76
56
54
62
52
60
124
10
74
116
60
120
9
9
64
66
118
131
58
129
100
104
68
102
116
74
106
72
108
98

FIG.7.
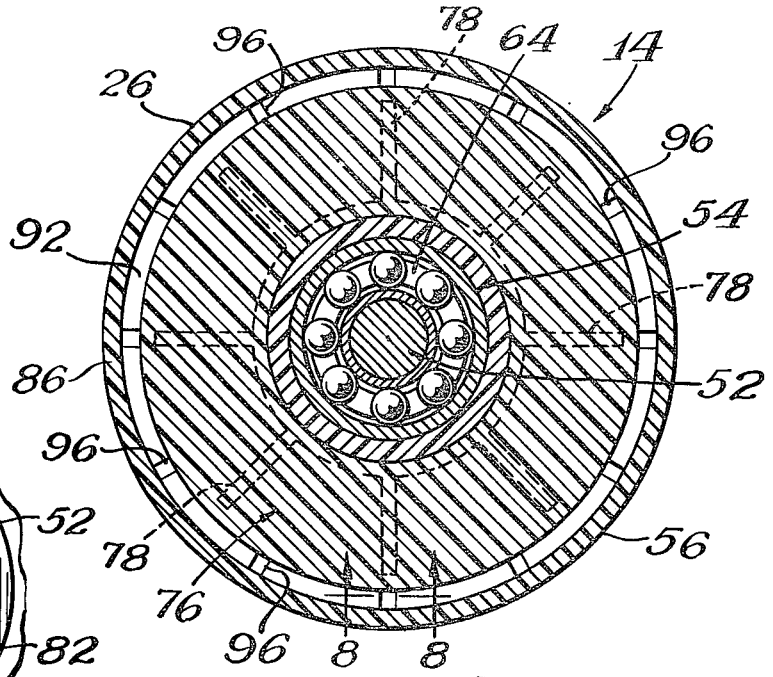
FIG.6.
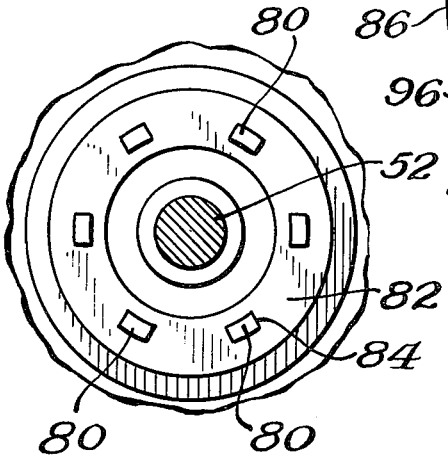
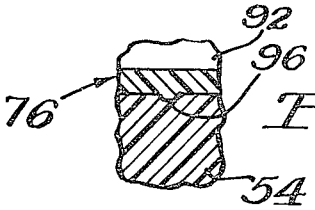
FIG.8.
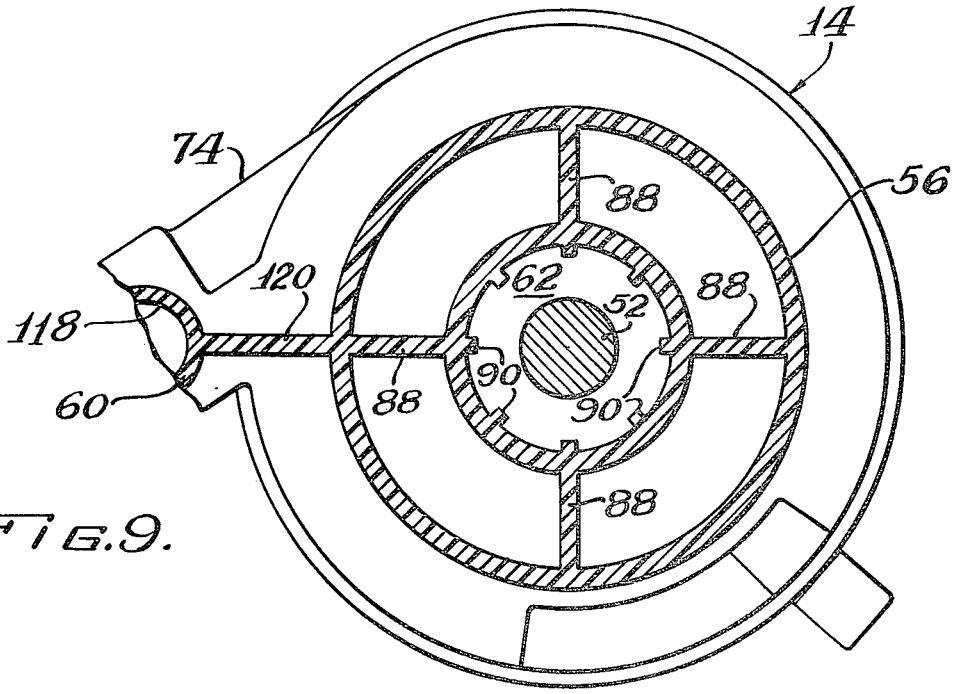
FIG.9.

HYDROTHERAPY BATH ASSEMBLY

BACKGROUND OF THE INVENTION

FIELD OF THE INVENTION and DESCRIPTION OF THE PRIOR ART

This is a continuation-in-part to my application, Ser. No. 420,225, filed Nov. 29, 1973 now abandoned.

This invention relates to an improved portable hydrotherapy or whirlpool bath assembly of the type which is conventionally mounted on the upper edge of the wall of a bath tub.

Hydrotherapy or whirlpool bath assemblies of the portable type have been in use for many years. These hydrotherapy bath assemblies are used by immersing the pump portion of the hydrotherapy bath unit into water in a bath tub and then a person immerses himself in the swirling water created by the hydrotherapy bath assembly in the tub.

Generally speaking, the known hydrotherapy bath assemblies have a motor housing and a pump housing which are interconnected by an overhead support to define a generally inverted U-shape for the device. The motor housing is positioned outside the tub and the pump housing is positioned within the bath water in the tub and the central lower surface portion of the overhead support assembly rests on the upper edge of the tub wall. The motor drives the pump and the pressurized water creates a swirling or whirlpool effect in the tub. The hydrotherapy bath assemblies conventionally have an aeration device for mixing air with pressurized water.

Although the known hydrotherapy bath units have been generally useful, there are certain disadvantages and drawbacks found in most of the known units. For example, one drawback of the known hydrotherapy units is the lack of versatility in use, that is, the lack of a simple and convenient water flow control, the lack of a simple and convenient aeration control, the inability to change the direction of the pressurized water flow once the unit is immersed in water, and the difficulty in directing the pressurized water to localized areas of the user's body. For example, if a person has a "stiff" shoulder or calf muscle, it is difficult to direct the water from the hydrotherapy bath unit directly against that part of the body which is normally remote from the water outlet. Also, any way in which the weight of the portable hydrotherapy bath units can be reduced without adversely affecting the operation thereof, is also considered to be highly advantageous. Thus, any way in which metal parts can be replaced by lighter weight parts, such as plastic parts, is considered highly desirable.

SUMMARY OF THE INVENTION

It is therefore an important object of this invention to provide an improved hydrotherapy or whirlpool bath assembly wherein the hydrotherapy bath unit is characterized by enhancement of its versatility in use.

It is also an object of this invention to provide an improved hydrotherapy bath unit wherein the unit includes a water volume control, an aeration control, and a control for varying the direction of the pressurized water flowing into the tub.

It is still another object of this invention to provide an improved hydrotherapy or whirlpool bath assembly, wherein the pump housing is rotatable relative to the overhead support of the unit so that the direction of the pressurized water flowing from the pump can be varied over a wide range.

It is yet another object of this invention to provide an improved hydrotherapy bath unit which is adapted to receive a flexible hose for directing pressurized water to any desired location of the user's body.

A related object of the present invention is to provide an improved hydrotherapy bath unit of the type described wherein a pair of flexible hoses may be connected with the water outlet of a pump for directing pressurized water simultaneously to more than one localized part of the user's body.

It is yet a further object of this invention to provide an improved hydrotherapy bath unit wherein the pump housing is a unitary molded plastic construction which is light in weight and yet rigidly constructed.

It is also another object of the invention to provide an improved hydrotherapy bath assembly which is characterized by its simplicity and economy of construction, ease of operation, and versatility in use.

Further purposes and objects of this invention will appear as the specification proceeds.

The foregoing objects are accomplished by my improved hydrotherapy bath assembly which includes a main housing, a unitary pump housng, an upright drive shaft operatively connected to a motor positioned within the main housing with the drive shaft being rotatably mounted within the pump housing, means for rotatably mounting the upper end of the pump housing on the main housing for rotating the pump housing about the axis of the upright drive shaft, a central water inlet in the lower end of the pump housing including a control for adjusting the volume of water passing to the pump impeller, the pump impeller raising the pressure level of the water, and a pressurized water outlet unitary and rotatable with the pump housing for changing the direction of pressurized water flow from the outlet and an aeration unit for mixing air with the pressurized water passing through the outlet, the aeration unit including a control for adjusting the quantity of air mixed with the water, the aeration unit being unitary with the pump housing. In a preferred form of the invention, a flexible hose is connected to the pump outlet for directing the pressurized water to a remote part of the user's body. Alternatively, more than one such hose may be connected to the pump outlet for directing water simulatneously to several, localized parts of the user's body.

BRIEF DESCRIPTION OF THE DRAWINGS

Particular embodiments of the present invention are illustrated in the accompanying drawings wherein:

FIG. 6 is a cross sectional view taken along the line 6—6 of FIG. 3 illustrating a portion of the locking assembly for securing the pump housing to the overhead support of the hydrotherapy bath assembly;

FIG. 7 is a sectional view taken along the line 7—7 of FIG. 3 illustrating the rotatability between the pump housing and the overhead support, with detents shown thereon;

FIG. 8 is a detailed view taken along the line 8—8 of FIG. 7 illustrating a single detent;

FIG. 9 is a cross sectional view taken along the line 9—9 illustrating the construction of the lower portion of the pump housing;

DETAILED DESCRIPTION OF THE PREFERRED EMBODIMENT

Figure 1:
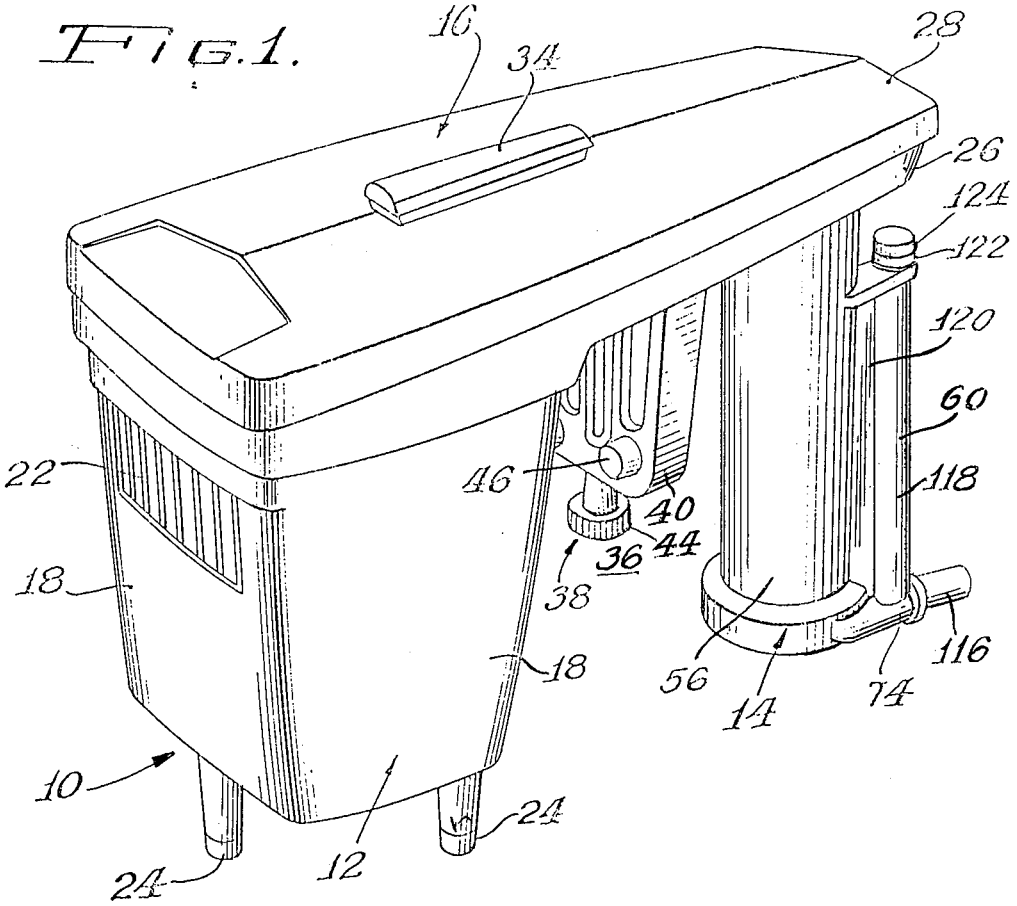
FIG. 1 is a pictorial view illustrating a preferred embodiment of my improved hydrotherapy or whirlpool bath assembly.
Figure 2:
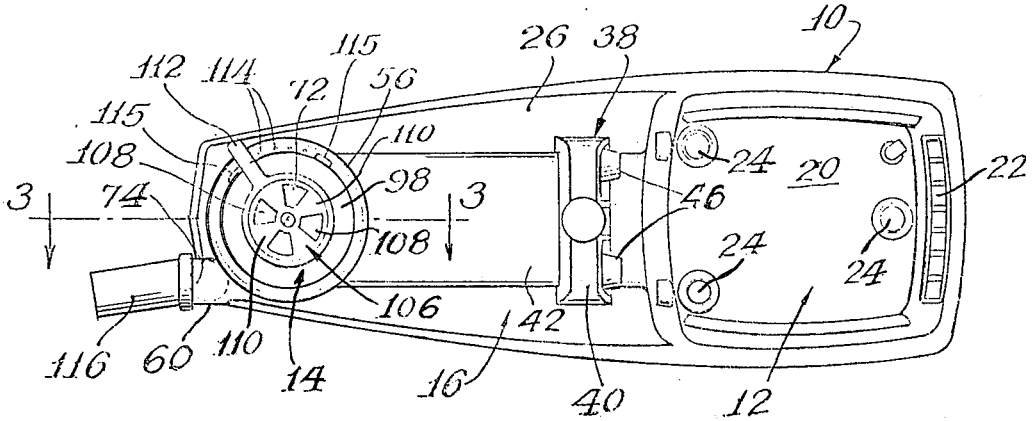
FIG. 2 is a view of the underside of the embodiment of FIG. 1.

Referring to the drawings, particularly to FIGS. 1 and 2, the hydrotherapy bath assembly, generally 10, includes a motor housing, generally 12, a pump housing, generally 14, and an overhead support assembly, generally 16, which is secured to the upper ends of both the motor housing 12 and the pump housing 14.

The motor housing 12 generally includes four side walls 18 and a bottom wall 20. An air vent 22 is located in the side wall 18 which is opposite the pump housing 14 for cooling of a drive motor (not shown). A plurality of support feet 24 are secured to the underside of the wall 20 and may be used for resting the hydrotherapy bath assembly 10 on the floor for storage. A drive motor (not shown) is rigidly mounted within the motor housing 12. The motor housing 12 is preferably constructed of a suitable molded plastic, such as Lexan or Cycolac. The upper end of the motor housing 12 is open and is rigidly secured by suitable means, as screws (not shown), to the overhead support assembly 16.

Figures 3, 4, 5:
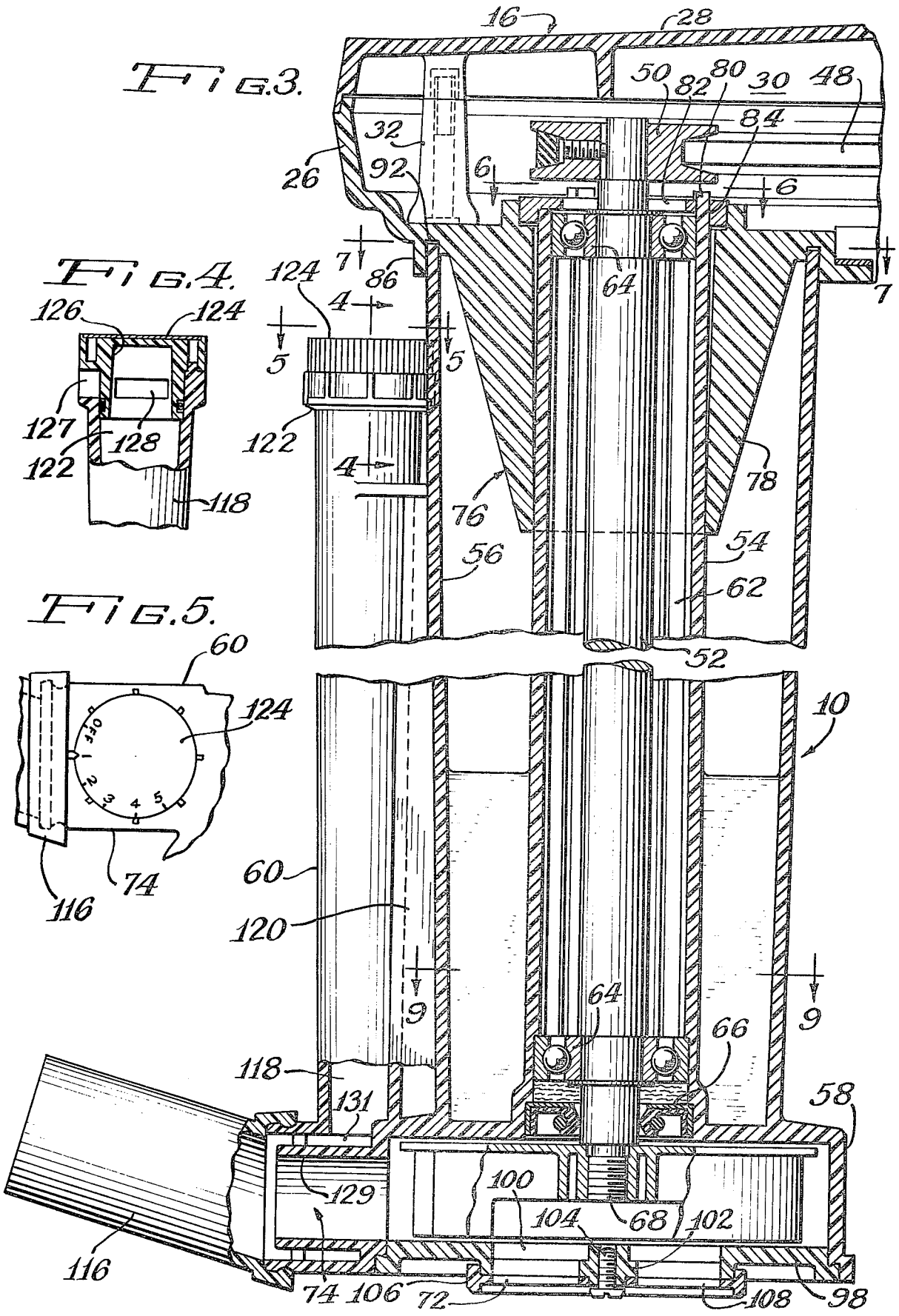
FIG. 3 is an enlarged sectional view taken along the line 3—3 of FIG. 2 illustrating the internal construction of the pump housing.
FIG. 4 is a partially sectioned, detailed view taken along the line 4—4 of FIG. 3 showing the aeration control assembly.
FIG. 5 is a fragmentary plan view taken along the line 5—5 of the embodiment of FIG. 3.

As seen best in FIGS. 1 and 3, the overhead support assembly 16 generally includes an elongated base portion, generally 26, and a mating cover, generally 28. Like the motor housing 12, the base portion 26 and the cover 28 are preferably constructed of molded plastic, such as Lexan or Cycolac. As seen in FIG. 3, a chamber 30 is defined between the mating base portion 26 and cover 30. The base portion 26, as seen in FIG. 3, includes a plurality of upright hollow columns 32 which threadably receive a plurality of cooperating screws passing through the upper wall of the cover 28. The central portion of the cover 28 has a handle 34 secured thereto for conveniently transporting the hydrotherapy bath assembly 10.

An open space 36 is defined below the overhead support 16 and between the pump housing 14 and the motor housing 12 to define an inverted U-shaped therefor. The assembly 10 is designed for resting on the upper edge of a bath tub wall. Specifically, the undersurface of the base portion 26 of the overhead support assembly 16 rests on a bath tub wall (not shown).

A clamp assembly, generally 38, is longitudinally slidably mounted and lockable on the undersurface of the overhead support 16, as seen best in FIGS. 1 and 2. The clamp assembly 38 includes an upright slidable wall 40 which is movable between the pump housing 14 and the motor housing 12. The underside of the base portion 26, as seen in FIG. 2, defines a track 42 which slidably engages the cooperating upper portion of the slidable upright wall 40. A threaded stud 33 passes upwardly through the central portion of the wall 40 and is adapted to lockably bear against the lower surface of the track 42 to lock the slidable wall 40 in position so that the pads 46 on the outer surface of the upright wall 40 bear against the inner surface of a bath tub wall, the wall 40 (and pump housing 14) being located in the tub and the motor housing 14 being located outside the tub.

Referring to FIG. 3 a V belt 48 is horizontally positioned within the overhead chamber 30 defined between the base 26 and cover 28. The V-belt 48 operatively engages a drive sheave (not shown) mounted on a drive shaft (not shown) which is driven by the drive motor (not shown) in the motor housing 12. The V-belt 48 also operatively engages a sheave 50 which is nonrotatably secured to the upper end of the upright drive shaft 52 in the pump housing 14.

The pump housing 14, which is an important part of the invention, is of unitary construction and performs multiple functions. The pump housing 14 includes a central substantially cylindrical wall, generally 54, an outer substantially cylindrical wall 56, a lower pump chamber, generally 58, and an aerator section generally 60. The central wall 54 defines a central upright chamber 62 through which the drive shaft 52 passes. The upper and lower ends of the inner surface of the central wall 54 securely receive roller bearing assemblies 64 which rotatably support the upper and lower ends of the drive shaft 52 within the chamber 62. In order to avoid the passage of water into the area of the lower bearing 64, in particular, and generally into the drive shaft chamber 62, a liquid seal 66 is sealably positioned against the lower end of the drive shaft 52 below the lower bearing 64 and above the pump chamber 58, thereby sealing the chamber 62 from the pump chamber 58. The seal 66 serves an important function of maintaining the bearings 64 free from contact with water which could ultimately lead to an adverse effect on the operation of the bearing 54.

The lower end of the drive shaft 52 is threaded at 68 for rotatably receiving an impeller assembly 70. The impeller assembly 70 and pump chamber 58 define a centrifugal pump for raising the pressure of the water passing through the central water inlet, generally 72, to a desired level at the pressurized water outlet, generally 74.

The cylindrical outer upper surface of the central wall 54 is rotatably received by the cylindrical inner surface of a downwardly projecting cylindrical support portion 76 which is unitarily formed with the base portion 26 of the overhead support 16, defining a bearing surface for rotation of the central wall 54 relative to the overhead support. As will be described, the rotatability between the pump housing 14 and the overhead support 16 provides an important advantage in enabling the user of the bath assembly 10 to vary the direction of the pressurized water flowing tangentially from the outlet 74. The unitary support portion 76 of the base portion 26 extends a relatively short distance downwardly from the base 26 and is held rigid by a plurality of supporting radial ribs 78 which project upwardly and outwardly from the outer periphery of the support portion 76. The ribs 78 are unitary both with the support portion 76 and the base portion 26.

The upper edge of the central wall 54 has a plurality of arcuately shaped upward projections 80 unitarily formed thereon. The arcuate projections 80 lockably engage a locking ring 82 which lockably engage apertures 84 therein for the arcuate projections 80. The locking ring 82 and arcuate projections 80 are best seen by referring to FIGS. 3 and 6. The outer periphery of the locking ring 82 is locked to the wall 54 and is rotatable therewith relative to the base 26 including an upper, unitary, cylindrical outer ring 86 defined in the upper surface of the lower wall of the base portion 26.

The outer wall 56 of the unitary pump housing 14 is spaced outwardly from the central wall 54 and is rigidly interconnected thereto by a plurality of reinforcing radial ribs 88 at the lower portion of both the central wall 54 and the outer wall 56, as seen best in FIGS. 3 and 9, and also by the wall defining the top of the pump chamber 58. The interconnecting ribs 88 rigidly interconnect the central wall 54 and outer wall 56 and also act to rigidify the support for the entire pump housing 14. A plurality of interior longitudinal upright ridges 90 act to reinforce the central wall 54. An annular space is defined between the walls 54 and 56.

The outer, substantially cylindrical wall 56 is also rotatably received by the base portion 26. Specifically, as seen best in FIGS. 3 and 7, a circular groove 92 is defined in the lower surface of the lower wall defining the base portion 26. The groove 92 is defined on its exterior by an outer downwardly projecting cylindrical wall 86. As seen best in FIGS. 7 and 8, a plurality of detents are defined in the groove 92 and in the upper edge of the wall 94. The detents 96 cooperate to maintain the pump housing 14 in a desired rotated position relative to the overhead support assembly 16.

It is seen that both the upper edge of the central wall 54 and the upper edge of the outer wall 56 are rotatably movable relative to the base portion 26. The unitary ribs 88 provide for rigid interconnection between the walls 54 and 56 and at the same time, the locking ring 82 locks the upper section of central wall 54 in place relative to the base portion 26.

The pump chamber 58 is positioned at the lower end of the pump housing 14 and is substantially cylindrical in shape with the height being substantially less than the diameter of the cylindrical pump chamber 58. The impeller assembly 70 and the pump chamber cooperate to define a centrifugal pump which is adapted to coaxially receive water at the central, lower portion thereof, increase the water pressure by centrifugal rotation of the impeller 70, in a conventional manner, and passing the pressurized water tangentially outwardly through the pump outlet 74, unitarily and tangentially defined on the pump housing 14, as seen in FIGS. 2 and 6.

The water inlet 72 includes a substantially annular closure wall 98 having an outer periphery which is adhesively and rigidly secured to the cylindrical wall defining the outer periphery of the pump chamber 58. The annular closure wall 98 is completely enclosed along its outer peripheral portion and includes pie-shaped ribs 100, separating pie-shaped openings, terminating in a central hub 102, as seen best in FIG. 3. The hub 102 threadably receives a screw 104 which secures a rotatable control plate 106 over the water inlet openings defined in the closure wall 98. The control plate 106 is rotatably received over the rib area, with pie shaped apertures 108, as seen in FIG. 2 being separated by rib sections 110 which are adapted to cover the inlet apertures in the closure wall 98 in varying degrees as from a relatively small area opening to a full inlet opening, with a plurality of openings positions being defined between full closed and full open. The control plate 106, as seen in FIG. 2, includes a unitary control arm 112, which provides for convenience for the user in rotating the control plate 106 to the desired position. The arm 112 has a projection which cooperates with depressions 114 in the closure wall 98 to define detents for substantially locking the control plate 106 in the desired rotated position. The positions defined by the detents have an important advantage in enabling the user to repeat the same desired water treatment, time after time. Stops 115 engage the arm 117 to limit the arcuate movement of the arm 112 between its extremes.

The pressurized water outlet 74 is formed unitarily with the pump housing 14 as previously described. A rotatable directional member 116 is removably secured to the outer end of the pump outlet 74. The directional member 116 is rotatable about the longitudinal axis of the outlet portion 74 and is inclined at a slight angle relative to the axis of the outlet 74 so that the direction of the water flow may be varied as the directional member 116 is rotated. As is conventional with centrifugal pumps, the outlet 74 has its central axis positioned substantially tangential to the impeller assembly 70 for tangentially receiving the pressurized water.

The upright aerator section 60 comprises a central upright tube 118 which is rigidly secured to the outer periphery of the outer wall 56 of the pump housing 14 by a rigid rib 120. The tube 118 has an open upper end 122, as seen best in FIG. 4. A control cap 124 encloses the open end 122. The control cap 124 includes an enclosed upper wall as best seen in FIG. 5, and a downwardly directed cylindrical side wall 126. The side wall 126 includes apertures 128 which are alignable with a plurality of apertures 127 provided in the outer upper wall of the aerator tube 118. As seen in FIG. 5, the control cap 124 is rotatable relative to the upper end of the tube 122, so as to control the amount of air entering the aeration tube 118. By varying the size of the opening, by rotation of the cap 124, the quantity of air mixed with the pressurized water flowing through the outlet 74 may be varied. As with the water inlet control, the user may readily repeat the amount of aeration desired by having definite settings. The pressurized water passing through the outlet 74 creates a venturi effect to cause aeration of the pressurized water by the air passing through the annular chamber 131 surrounding the water outlet tube 129.

Figure 10:
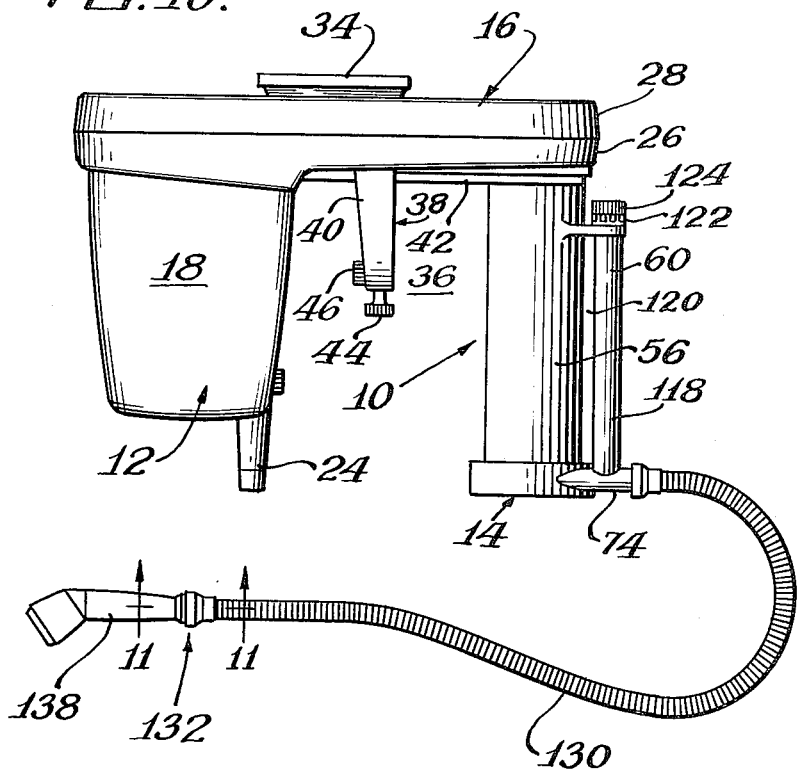
FIG. 10 is a side elevational view of the hydrotherapy bath unit embodied in FIG. 1, with a flexible hose mounted on the water outlet enabling the pressurized water to be directed to a desired location, on the user's body.
Figure 11:
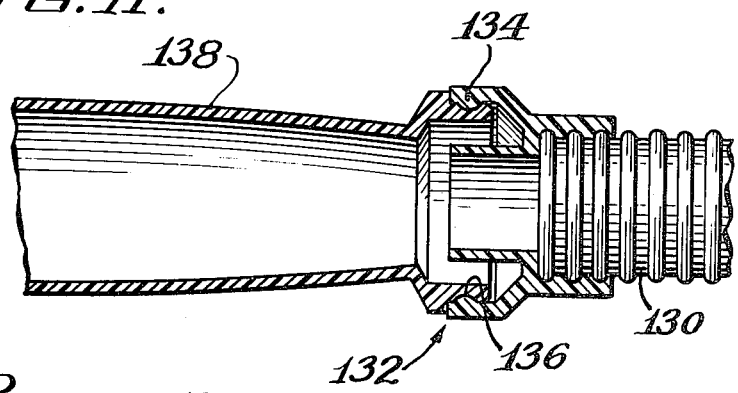
FIG. 11 is a fragmentary enlarged sectional view taken along the line 11—11 of FIG. 10, illustrating the structure for interconnecting the nozzle to the flexible hose.
Figure 12:
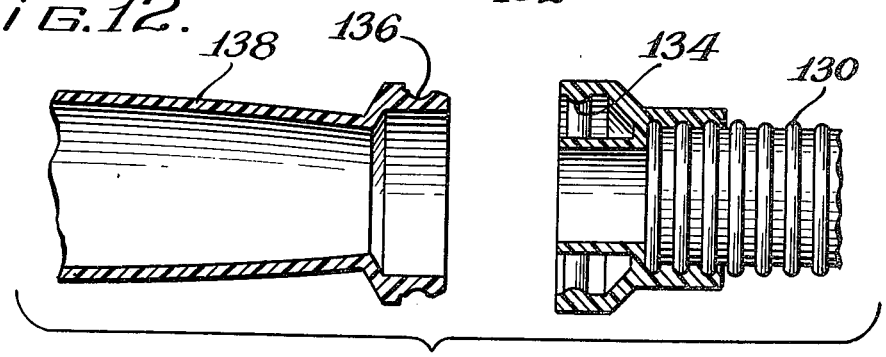
FIG. 12 is a view similar to FIG. 11 with the interconnecting parts shown in exploded view.

Referring to FIGS. 10–12, there is shown a preferred embodiment of my invention utilizing a flexible hose 130, which is removably secured to the outlet 74 of the hydrotherapy bath assembly 10. The hose 130 includes a connecting portion 132 made of a flexible molded material having an inner peripheral groove 136 positioned on a nozzle member 138. Preferably, a plurality of nozzle members 138 of varying types may be secured to the outer end of the flexible tube 130. The use of the flexible hose or tube 130 has a significant advantage in that the nozzle member 138 may direct the pressurized water to any desired location of the user's body, as to a stiff arm or shoulder which otherwise could not be easily treated by the pressurized water flowing from the hydrotherapy bath assembly 10.

Figure 13:
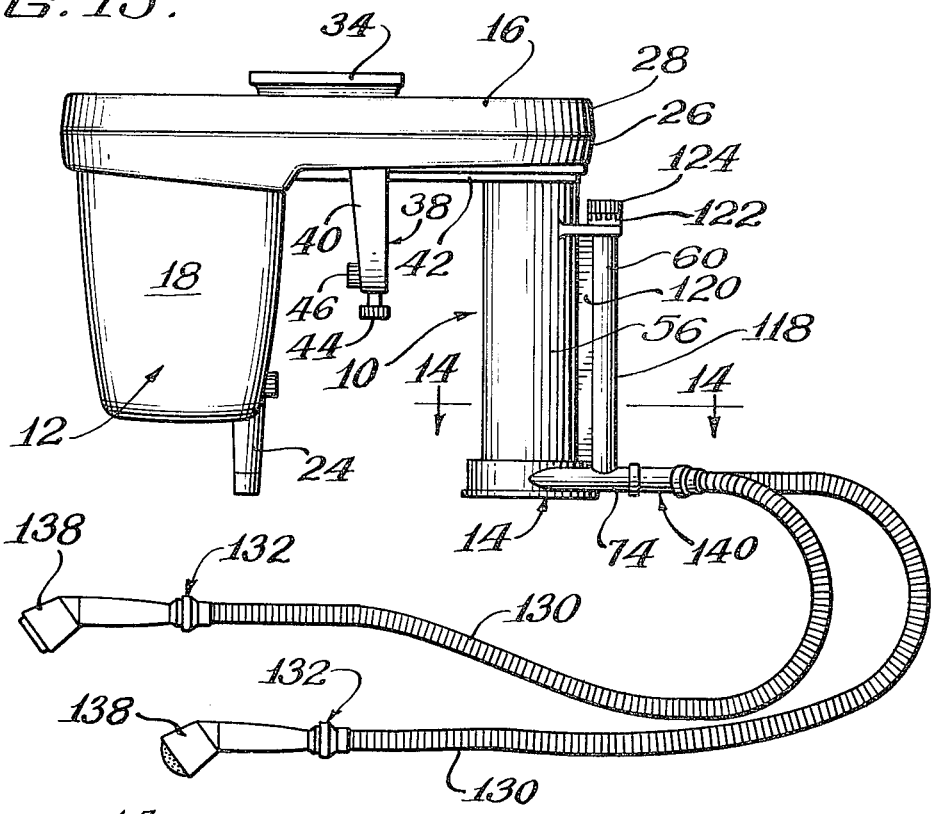
FIG. 13 is a view similar to FIG. 10 with a pair of flexible hoses mounted on the water outlet enabling the pressurized water to be directed simultaneously to two localized parts of the user's body.
Figure 14:
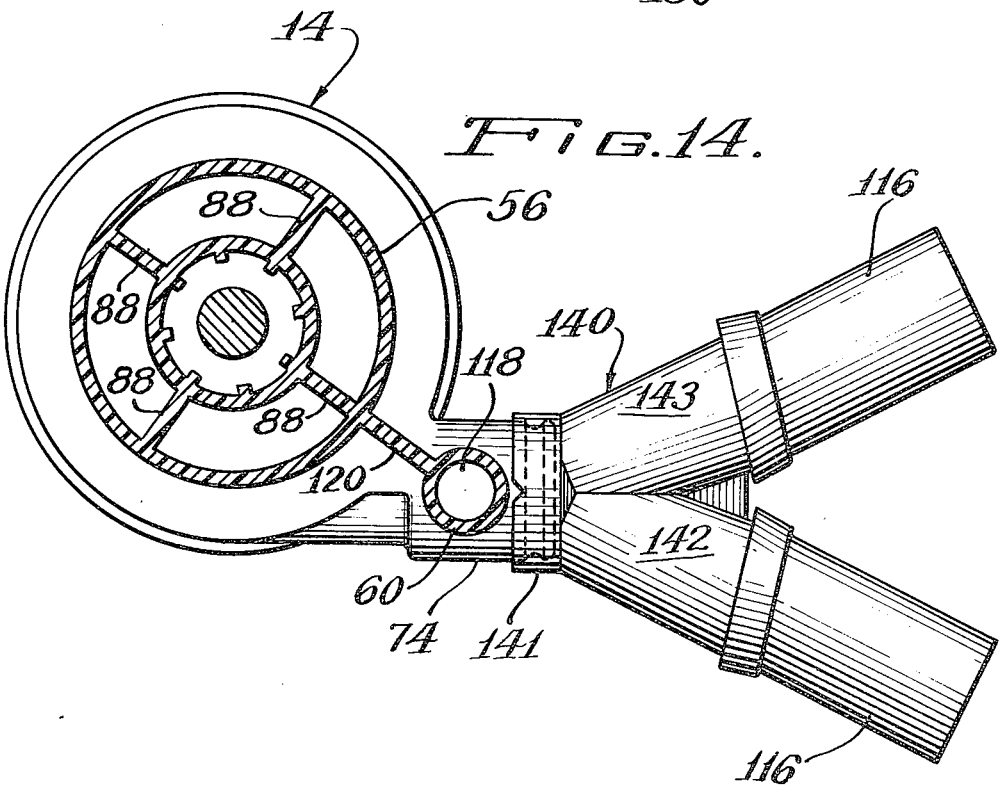
FIG. 14 is a partially sectional, detailed view taken along the line 14—14 of FIG. 13 showing a pair of rotatable directional members connected to the pump outlet
Figure 15:
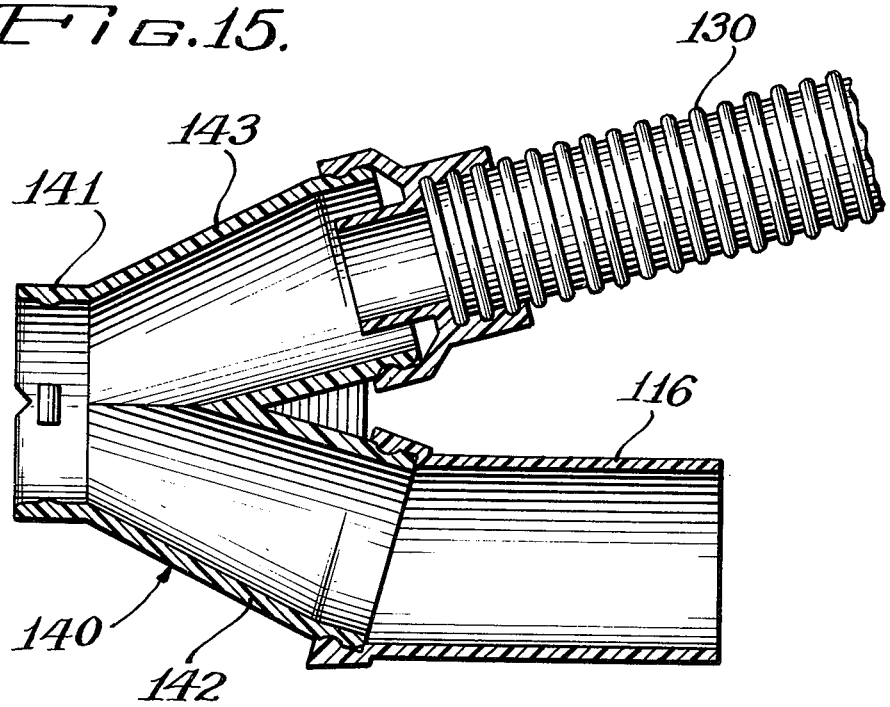
FIG. 15 is an enlarged, sectional view of the bifurcated member that may be connected to the pump outlet and showing a rotatable directional member and a flexible hose connected to the two outlet ends of this bifurcated member.

Referring to FIGS. 13–15, a bifurcate member 140 is removable secured to the outlet 74 of the hydrotherapy bath assembly 10. The member 140, preferably made of molded plastic, is generally Y shaped and has a base portion 141 that may be removable secured to the outlet 74. A pair of outlets 142 and 143 are integrally formed with and extend from the base portion 141. The outlets 142 and 143 define a bifurcated flow path for the pressurized water being emitted from the outlet 74. The inner end 144 of a flexible tube or hose 130 may be removably secured to the outlets 142 and 143, such as shown in FIG. 14, or the inner end 144 of a tube 130 and a rotatable directional member 116 may be secured to the outlets 142 and 143, such as shown in FIG. 15. The bifurcated member 140 provides significant flexibility in the user of the hydrotherapy bath assembly 10 in that pressurized water may be directed simultaneously to two localized parts of the user's body. Alternatively, pressurized water from the outlet 74 may be directed to any desired location of the user's body while also being directed in the bath tub in the same as if just a single member 116 was being utilized.

It is seen from the foregoing, that I have provided a highly versatile and useful hydrotherapy bath assembly. The assembly 10 is light in weight due to its predominant use of molded sturdy plastic material. The versatility of the device is provided by controls for adjusting the quantity of water flow and by providing suitable controls for permitting the quantity of water aeration to be easily adjusted. These controls have definite settings which enable the user to readily repeat the same treatment that is, water volume and amount of aeration. Additionally, the entire housing assembly is rotatable relative to the support assembly 16 so that the tangential outlet 74 may be positioned at any desired rotated position relative to the upright axis of the pump housing 14. Additionally, in the preferred embodiment, a flexible hose having an outlet nozzle thereon, is secured to the outlet 74 to enable an even more versatile use of the assembly by permitting the pressurized water to be directed to almost any desired location of the ser's body. In another embodiment, a pair of flexible hoses may be secured to the pump outlet 74 so as to afford even greater versatility of use. It is seen that the assembly 10 is characterized by control over the volume of water flow, control over the amount of aeration, and the control in the direction of flow from the outlet.

In addition to the above advantages, the pump housing 14 is an important feature of the invention as it is characterized by its unitary, multi-purpose construction. The unitary pump housing is molded of Lexan or Cycolac, provides a chamber for the drive shaft, provides a pump chamber, provides inlet control means for the pump chamber, provides an aeration unit, provides an outlet for the pressurized water and provides means for cooperating with the overhead support to rotatably mount the pump housing for directional control of flow.

While in the foregoing, there has been provided a detailed description of particular embodiments of the present invention, it is to be understood that all equivalents obvious to those having skill in the art are to be included within the scope of the invention as claimed.

What I claim and desire to secure by Letters Patent Is:

1. In a portable hydrotherapy bath assembly wherein the bath assembly includes: an overhead support housing; a motor housing which has a motor positioned therein and which is connected with one end of the overhead support housing; a pump housing which has a pump drive shaft supported therein for rotation about its longitudinal axis and which is connected, at its one, upper end, with the other end of the overhead support housing so that the overhead support housing, the motor housing and the pump housing have a generally inverted U-shape and so that the overhead support housing may rest on the upper edge of a bath tub, with the motor housing being disposed without the bath tub and with the other, lower end of the pump housing being immersed in water in the bath tub; wherein the overhead housing including means for connecting the upper end of the pump drive shaft with the motor so that the motor may cause rotation of the pump drive shaft; and wherein a pump impeller is connected with the lower end of the pump drive shaft; the improvement comprising:

a unitary pump housing body including: a first, outer cylindrical wall having an upper end and a lower end; a second, inner cylindrical wall, which has an upper end and a lower end, which is concentric with and is spaced radially inwardly from the first outer cylindrical wall so as to define an annular chamber therebetween and which defines a central, cylindrical chamber that has the pump drive shaft disposed and supported therein for rotation; a pump chamber which is adjacent to the lower ends of the first and second cylindrical walls, which has the pump impeller disposed therein and which has a water inlet for permitting the ingress of water into the pump chamber and a water outlet for permitting the egress of water, under pressure, from the pump chamber; wall means extending between the lower ends of the first and second cylindrical walls for closing the lower end of the annular chamber and for isolating the annular chamber from the pump chamber; and an upright aerator tube positioned adjacent to the outer periphery of the first cylindrical wall and communicating with the water outlet;

a base forming a part of the other end of the overhead support housing and including: a downwardly projecting, cylindrical support portion that receives and supports the upper end of the second cylindrical wall while permitting relative rotational movement therebetween; and a downwardly facing, circular groove that is concentric with the cylindrical support portion and receives the upper end of the first cylindrical wall while permitting relative rotational movement therebetween;

means cooperating with the upper end of the second cylindrical wall and the cylindrical support portion for preventing relative, axial movement between the unitary pump housing body, and the cylindrical support portion; and detent means cooperating with the first cylindrical wall and the annular groove for maintaining the unitary pump housing body in a desired rotated position relative to the overhead support housing.

2. In the assembly described in claim 1 wherein the unitary pump housing body includes a plurality of radially extending ribs integral with the first and second cylindrical walls and extending therebetween; and wherein the cylindrical support portion includes a plurality of radial ribs which project upwardly and outwardly in the annular chamber from the outer periphery of the cylindrical support portion.

3. In the assembly described in claim 1 wherein the means for preventing relative axial movement between the second cylindrical walls and the cylindrical support portion includes a locking ring mounted on the upper end of the first cylindrical wall.

4. In the assembly described in claim 1 wherein the detent means includes a plurality of detents defined in the annular groove and in the upper end of the first cylindrical wall.

5. In the assembly described in claim 1 wherein the bearing means are disposed adjacent to the upper and lower ends of the central cylindrical chamber for rotatably supporting the pump drive shaft in the central cylindrical chamber; and wherein sealing means are disposed adjacent to the lower end of the central cylinder chamber for preventing water in the pump chamber from entering the central cylindrical chamber.

6. In the assembly described in claim 1 wherein inlet control means are mounted on the pump housing body adjacent to the water inlet for selectively controlling the ingress of water into the pump chamber; and wherein the inlet control means includes a rotatable control plate with inlet apertures therein and means for setting said control plate at a desired position to enable the repeating of a desired treatment.

7. In the assembly described in claim 1 wherein the aerator tube includes means for controlling the volume of air mixing with the water being discharged from the pump chamber; and wherein the controlling means includes means for setting the controlling means at a desired position so as to enable the repeating of a desired treatment.

8. In the assembly described in claim 1 wherein at least one flexible hose is connected, at one end, to the water outlet; and wherein an outlet nozzle is mounted on the other end of the flexible hose for directing pressurized, aerated water to a desired location.

9. In the assembly described in claim 2 wherein the means for preventing relative axial movement between the second cylindrical walls and the cylindrical support portion includes a locking ring mounted on the upper end of the first cylindrical wall; wherein the detent means includes a plurality of detents defined in the annular groove and in the upper end of the first cylindrical wall; wherein bearing means are disposed adjacent to the upper and lower ends of the central cylindrical chamber for rotatably supporting the pump drive shaft in the central cylindrical chamber; and wherein sealing means are disposed adjacent to the lower end of the central cylindrical chamber for preventing water in the pump chamber from entering the central cylindrical chamber.

10. In the assembly described in claim 9 wherein inlet control means are mounted on the pump housing body adjacent to the water inlet for selectively controlling the ingress of water into the pump chamber; wherein the inlet control means includes a rotatable control plate with inlet apertures therein and means for setting said control plate at a desired position to enable the repeating of a desired treatment; wherein the aerator tube includes means for controlling the volume of air mixing with the water being discharged from the pump chamber; wherein the controlling means for setting the controlling means at a desired position so as to enable the repeating of a desired treatment; wherein at least one flexible hose is connected, at one end, to the water outlet; and wherein an outlet nozzle is mounted on the other end of the flexible hose for directing pressurized, aerated water to a desired location.

* * * * *